US009785096B2

(12) United States Patent
Morita

(10) Patent No.: US 9,785,096 B2
(45) Date of Patent: Oct. 10, 2017

(54) IMAGE FORMING APPARATUS

(71) Applicant: Konica Minolta, Inc., Chiyoda-ku, Tokyo (JP)

(72) Inventor: Shinji Morita, Kunitachi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/217,192

(22) Filed: Jul. 22, 2016

(65) Prior Publication Data

US 2017/0060040 A1 Mar. 2, 2017

(30) Foreign Application Priority Data

Aug. 28, 2015 (JP) ..... 2015-168689

(51) Int. Cl.
*G03G 15/00* (2006.01)
*G03G 15/16* (2006.01)

(52) U.S. Cl.
CPC ..... *G03G 15/1615* (2013.01); *G03G 15/757* (2013.01); *G03G 2221/1657* (2013.01)

(58) Field of Classification Search
CPC ..... G03G 15/757; G03G 21/1647; G03G 2221/1657; G03G 21/1857; G03G 15/1615
USPC ..... 399/167
See application file for complete search history.

(56) References Cited

U.S. PATENT DOCUMENTS

2005/0025523 A1* 2/2005 Iwasaki ..... G03G 15/757 399/167
2005/0111882 A1* 5/2005 Sudo ..... G03G 15/0806 399/222
2013/0245629 A1* 9/2013 Xie ..... A61B 17/162 606/80

FOREIGN PATENT DOCUMENTS

JP 08-087225 A 4/1996
JP 2005-062806 A 3/2005

* cited by examiner

*Primary Examiner* — Walter L Lindsay, Jr.
*Assistant Examiner* — Frederick Wenderoth
(74) *Attorney, Agent, or Firm* — Squire Patton Boggs (US) LLP

(57) ABSTRACT

An image forming apparatus capable of obtaining a good image quality without color shifts is described. The image forming apparatus includes a drive coupling 1015 which couples a drive shaft 1011 and a flange 1021 of an image bearing member 613 with a play, a taper coupling 1017 supported inside the drive coupling 1015 for holding the drive shaft 1011 and the flange 1021, and a pressing member 1013. The taper coupling 1017 includes a tip portion 1061, an axial portion 1062, a rear end portion 1063. The drive coupling 1015 includes claw portions 1042 engaging with the flange 1021 of the image bearing member 613, and a body portion 1041 having a length which is shorter than the distance between the flange 1021 of the image bearing member 613 and the rear end 1063 of the taper coupling 1017 in the axial direction of the drive shaft 1011.

5 Claims, 6 Drawing Sheets

IMAGE FORMING APPARATUS

CROSS-REFERENCE TO RELATED APPLICATIONS

The present application claims priority under 35 U.S.C. §119 to Japanese Patent Application No. 2015-168689, filed Aug. 28, 2015. The contents of this application are herein incorporated by reference in their entirety.

BACKGROUND OF THE INVENTION

Field of the Invention

The present invention relates to an image forming apparatus.

Description of Related Art

Heretofore, there are image forming apparatuses called tandem color image forming apparatuses having image bearing members corresponding to respective primary colors, i.e., yellow (Y), magenta (M), cyan (C) and black (K). This type of image forming apparatuses forms toner images on the image bearing members corresponding to the colors respectively and superimposes the toner images on an intermediate transfer member, and transfers the superimposed toner images of the four different colors to a transfer sheet to form a color image.

The respective image bearing members are driven by drive units which are provided for these image bearings respectively. The drive unit transmits rotation to a rotation shaft from a main motor through a plurality of gears which reduces the rotation. The rotation shaft passes through the image bearing member which is cylindrical in order that the rotation shaft can be pulled out from the image bearing member, and is supported by a bearing on the opposite side to rotate the image bearing member.

The image bearing member receives rotation from the motor through a gear train consisting of a plurality of gears, and therefore each gear is required to have a necessary accuracy. Accordingly, a rotation irregularity, although which is small, can occur of the image bearing member under the influence of accumulated tolerance of the gears. Such a rotation irregularity of the image bearing member becomes a cause of image blurring.

From this fact, a drive shaft for transmitting a driving force from a motor or the like is connected to an image bearing member through a drive coupling which has a play in order that a rotation irregularity does not increase when rotation is transmitted from the motor to the image bearing member through a gear train even if there is an error such as an eccentricity between the drive shaft and the image bearing member (for example, refer to Japanese Patent Published Application No. 2005-62806).

On the other hand, the rattling between a drive shaft and a drive coupling can be prevented by forming a spline on the outer peripheral surface of the drive shaft and grooves corresponding to the spline on the inner surface of the drive coupling (for example, refer to Japanese Patent Published Application No. 8-87225).

However, the prior art technique described in Japanese Patent Published Application No. 2005-62806 can prevent the rotation irregularity of an image bearing member from increasing, but cannot prevent the oscillation between the image bearing member and a drive shaft caused by the rattling therebetween. On the other hand, the prior art technique described in Japanese Patent Published Application No. 8-87225 can improve the rattling between a drive shaft and a drive coupling, but cannot prevent the deterioration of the rotation irregularity of the image bearing member associated with an oscillation caused by a small rattling occurring at the contact portion of a spline and the like during driving.

Accordingly, in accordance with the prior art techniques, there is a fear that a good image quality cannot be obtained due to the rattling of an image bearing member and the rotation irregularity of the image bearing member.

The present invention is made in order to solve such a prior art problem and it is an object of the present invention to provide an image forming apparatus capable of obtaining a good image quality without color shifts.

SUMMARY OF THE INVENTION

To achieve at least one of the above-mentioned objects, reflecting one aspect of the present invention, an image forming apparatus transfers toner images formed on an image bearing member to a transfer target medium, and comprises: a drive shaft structured to transmit a rotation force to the image bearing member; a drive coupling supported movably in an axial direction of the drive shaft and structured to couple the drive shaft and a flange of the image bearing member with a play; a taper coupling supported inside the drive coupling and structured to hold the drive shaft and the flange of the image bearing member; a pressing member structured to press the taper coupling in the axial direction of the drive shaft, the taper coupling comprises: a tip portion having a tapered chuck structure and coming in surface contact with the drive shaft and the flange of the image bearing member by an elastic force of the tapered chuck structure and a pressing force of the pressing member; and an axial portion having a cylindrical structure whose outer diameter is smaller than the inner diameter of the drive coupling; and a rear end portion formed with a surface which comes in contact with the pressing member, and the drive coupling comprises: a claw portions engaging with the flange of the image bearing member; and a body portion having a length which is shorter than the distance between the flange of the image bearing member and the rear end of the taper coupling in the axial direction of the drive shaft.

Also, it is preferred that the image forming apparatus in accordance with the present invention as described above further comprises: a transmission pin which is passed through the drive shaft to transmit a rotation force to the drive coupling, and the drive coupling comprises: a first oblong hole formed on the body portion along the axial direction of the drive shaft and having a short diameter which is larger than the diameter of the transmission pin; a second oblong hole formed along the axial direction of the drive shaft opposite to the first oblong hole on the body portion and having a short diameter which is larger than the diameter of the transmission pin; and a first indentation formed in a long diameter side of the first oblong hole along a rotation direction of the first end portion of the transmission pin; and a second indentation formed in the long diameter side of the second oblong hole along a rotation direction of the second end portion of the transmission pin.

Furthermore, it is preferred that the first indentation and the second indentation of the above image forming apparatus in accordance with the present invention are formed respectively in such positions as to come in contact with the transmission pin at the same time when the transmission pin transmits a rotation force to the drive coupling.

DETAILED DESCRIPTION OF THE PREFERRED EMBODIMENT

In what follows, an embodiment of the present invention will be explained with reference to drawings. However, the present invention is not limited to the following specific embodiment.

Figure 1:
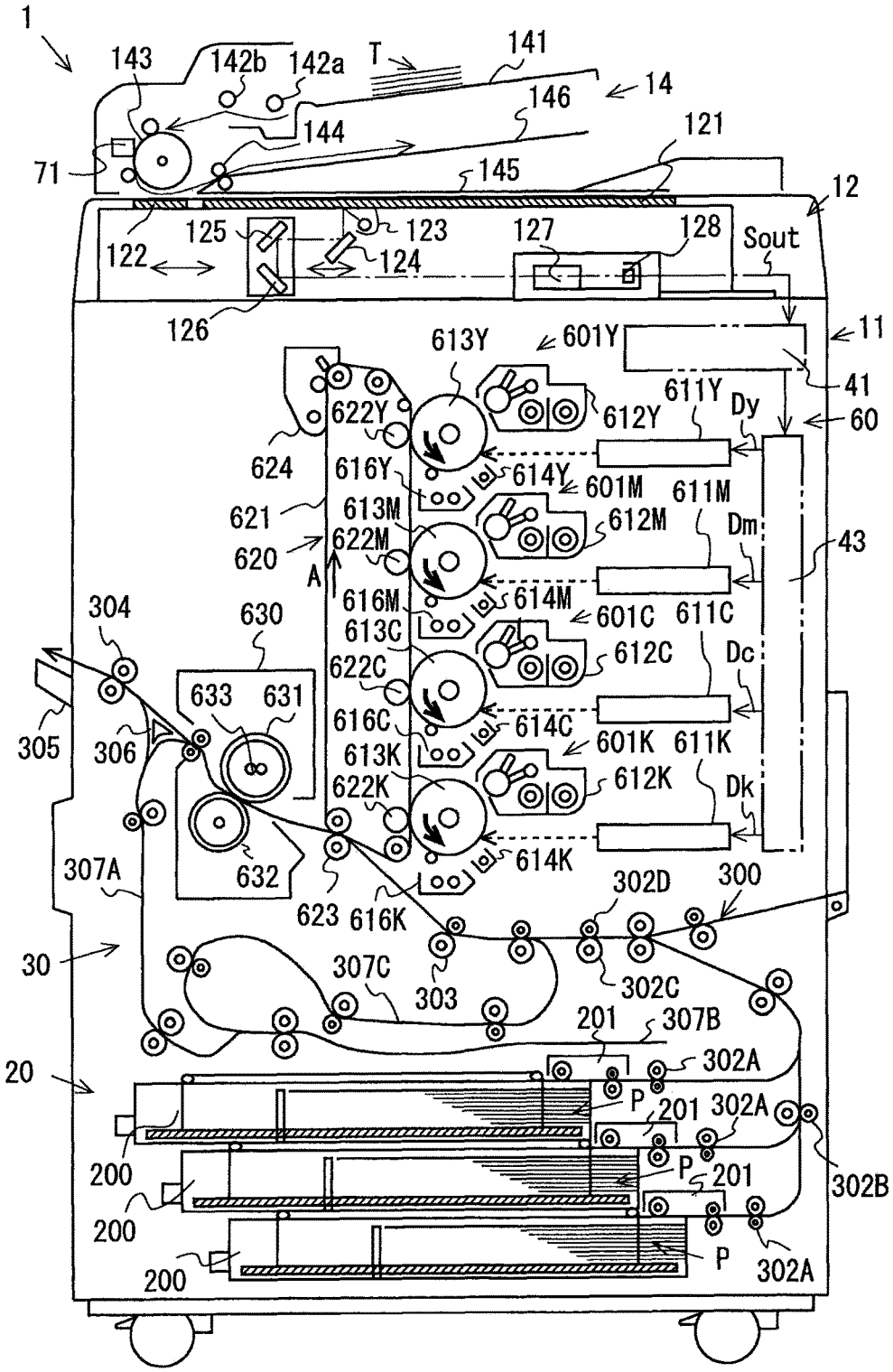
FIG. 1 is a schematic diagram for showing the overall configuration of an image forming system 1 in accordance with an embodiment.

FIG. 1 is a schematic diagram for showing the overall configuration of an image forming system 1 in accordance with the present embodiment. As illustrated in FIG. 1, the image forming apparatus 1 is an example of a color copying machine which acquires image information by reading images formed on an original T, and superimposes respective colors based on the acquired image information to form a full color image. The present invention can be preferably applied to a color printer, a facsimile machine or a multi-functional peripheral thereof, as the image forming apparatus 1, besides the color copying machine.

The image forming apparatus 1 is provided with an image forming apparatus body 11. A color image reading unit 12 and an automatic document feeder 14 are installed on the top of the image forming apparatus body 11. Although described in detail below, the image forming apparatus body 11 includes a control unit 41, an image processing unit 43, an image forming unit 60, a paper feed unit 20 and a conveyance unit 30.

Next, the automatic document feeder 14 will be explained. The automatic document feeder 14 is located on the image reading unit 12 and performs an operation of automatically feeding one or more original T in an automatic feeding mode. The automatic feeding mode is a mode in which an original T is fed from the automatic document feeder 14 to the image reading unit 12 which then reads an image printed on the original T.

More specifically, the automatic document feeder 14 is provided with an original placing member 141, a roller 142*a*, a roller 142*b*, a roller 143, a roller 144, a sheet reversing member 145 and a discharge tray 146. One or more original T is placed on the original placing member 141. The roller 142*a* and the roller 142*b* are located in the downstream side of the original placing member 141. The roller 143 is located in the downstream side of the roller 142*a* and the roller 142*b*. The automatic document feeder 14 is provided with a positioning sensor 71 on the outer circumference of the roller 143.

When the automatic feeding mode is selected, an original T fed from the original placing member 141 is conveyed by the roller 143 to form a U-shaped turn. Incidentally, when the automatic feeding mode is selected, an original T is placed on the original placing member 141 with its printed side facing up.

Also, after reading by the image reading unit 12, the original T is conveyed by the roller 144 and discharged onto the discharge tray 146. Meanwhile, the automatic document feeder 14 can convey the original T through the sheet reversing member 145 to read not only the printed side of the original T but also the opposite side to the printed side of the original T with the image reading unit 12.

Next, the image reading unit 12 will be explained. The image reading unit 12 performs an operation of reading a color image formed on an original T, i.e., a color image printed on the original T. The image reading unit 12 is provided with a one-dimensional image sensor 128. Also, in addition to the image sensor 128, the image reading unit 12 is further provided with a first platen glass 121, a second platen glass 122, a light source 123, mirrors 124, 125 and 126, an image forming optical unit 127 and an optical drive unit which is not shown in the figure.

The light source 123 irradiates an original T with light. The optical drive unit not shown in the figure moves the original T or the image sensor 128 in relation to each other in the subscanning direction. The subscanning direction in this case is the direction which is perpendicular to the main scanning direction in which are arranged a plurality of light receiving devices forming the image sensor 128.

Accordingly, an original T is conveyed by the automatic document feeder 14 and passed through an optical system of the image reading unit 12 to read an image(s) on either or both sides of the original T. Next, the incident light of the image reading operation is read by the image sensor 128. In a platen mode, the image sensor 128 outputs an image reading signal Sout which is obtained by reading an original T based on the RGB color model. This platen mode is a mode in which the optical drive unit not shown in the figure is driven to automatically read an image printed on an original T which is placed on a platen glass such as a first platen glass 121 and a second platen glass 122.

Next, the image sensor 128 will be specifically explained. The image sensor 128 includes three line color CCD imaging devices. Namely, the image sensor 128 consists of a plurality of light receiving element rows arranged in the main scanning direction. Specifically, read sensors which detect light corresponding to red (R), a green (G) and blue (B) divide picture elements in different positions in the subscanning direction perpendicular to the main scanning direction to read optical information corresponding to red, green and blue at the same time respectively. For example, when an original T is reversed by the roller 143 as a U-shaped turn in the automatic feeding mode, the image sensor 128 reads the surface of the original T and outputs an image reading signal Sout.

More specifically, the image sensor 128 photoelectrically converts an incident light, and is connected to the image processing unit 43 through the control unit 41.

The image reading signal Sout which is an analog signal photoelectrically converted by the image sensor 128 is processed by performing an analog process, A/D conversion, shading compensation, an image compression process, a variable magnification process and so forth. As a result, the image reading signal Sout becomes digital image data consisting of a red component, a green component and a blue component. The image processing unit 43 converts this digital image data, i.e., RGB code, into image signal Dy, Dm, Dc and Dk corresponding to color Y (yellow), color M (Magenta), color C (cyan) and color K (black) respectively. The image processing unit 43 transfers the converted data to LED writing units 611Y, 611M, 611C and 611K incorporated in the image forming unit 60.

Next, the image forming unit 60 will be explained in detail. The image forming apparatus 60 is an intermediate transfer type color image forming apparatus which makes use of an electrophotographic process technique. This image forming unit 60 is based on a vertical tandem system.

Specifically, the image forming unit 60 forms respective images based on the image data transferred from the image processing unit 43, i.e., signals Dy, Dm, Dc and Dk. The image forming unit 60 is provided with image forming units 601Y, 601M, 601C and 601K corresponding to the color components respectively, the intermediate transfer unit 620, and a fixing unit 630 for fixing toner images.

Next, the image forming unit 601Y will be explained. The image forming unit 601Y forms images of color Y (yellow). The image forming unit 601Y is provided with an image bearing member 613Y, a charging unit 614Y, an LED writing unit 611Y, a developing unit 612Y, and a cleaning unit 616Y.

The image bearing member 613Y forms a toner image of color Y. The charging unit 614Y is arranged in the vicinity of the image bearing member 613Y, and uniformly charges the surface of the image bearing member 613Y with negative charge by corona discharge. The LED writing unit 611Y irradiates the image bearing member 613Y with light corresponding to an image of color Y component. The developing unit 612Y forms a toner image by attaching a toner of color Y component to the surface of the image bearing member 613Y to visualize the electrostatic latent image. The cleaning unit 616Y removes residual transfer toner which remains on the surface of the image bearing member 613Y after a first transfer process.

Incidentally, each of the image forming units 601M, 601C and 601K has the similar constituent elements and functions as the image forming unit 601Y except for the color of images to be formed, and therefore redundant description is not repeated.

Meanwhile, the image forming units 601Y, 601M, 601C and 601K are referred to simply as the image forming unit 601 when they need not be distinguished. Also, the LED writing units 611Y, 611M, 611C and 611K are referred to simply as the LED writing unit 611. Furthermore, the developing units 612Y, 612M, 612C and 612K are referred to simply as the developing unit 612. Still further, the image bearing members 613Y, 613M, 613C and 613K are referred to simply as the image bearing member 613 when they need not be distinguished. Still further, the charging units 614Y, 614M, 614C and 614K are referred to simply as the charging unit 614. Still further, the cleaning units 616A, 616Y, 616M, 616C and 616K are referred to simply as the cleaning unit 616.

Next, the intermediate transfer unit 620 will be explained. The intermediate transfer unit 620 is provided with a transfer target medium 621, transfer rollers 622Y, 622M, 622C and 622K, a transfer roller 623, a belt cleaning apparatus 624 and the like.

The transfer target medium 621 is an endless belt which is wound around the plurality of support rollers in the form of a loop. At least one of the plurality of support rollers consists of a drive roller, and the others consist of non-driven rollers respectively. For example, preferably, the support roller located in the downstream side of the first transfer rollers 622K for K component in the belt running direction is preferably implemented as the drive roller in this case. When the drive roller rotates, the transfer target medium 621 runs at a constant speed in the direction indicated with arrow A.

The first transfer rollers 622Y, 622M, 622C and 622K are arranged in the inner surface side of the transfer target medium 621 and opposed to the image bearing members 613 in correspondence with the color components respectively. The first transfer rollers 622Y, 622M, 622C and 622K are urged against the image bearing members 613Y, 613M, 613C and 613K respectively through the transfer target medium 621. First transfer nip portions are thereby formed for transferring toner images from the image bearing members 613Y, 613M, 613C and 613K to the transfer target medium 621.

Incidentally, the first transfer rollers 622Y, 622M, 622C and 622K are referred to simply as the first transfer roller 622 when they need not be distinguished.

The second transfer roller 623 is located in the outer surface side of the transfer target medium 621 and opposed to one of the plurality of support rollers. The support roller located opposite the transfer target medium 621 is called a backup roller. A second transfer nip portion is formed by urging the second transfer roller 623 against the backup roller with the transfer target medium 621 therebetween for transferring the toner images from the transfer target medium 621 to a recording sheet P.

When the transfer target medium 621 is passed through the first transfer nip portions, toner images are successively transferred to the transfer target medium 621 from the image bearing member 613 and superimposed on the transfer target medium 621 respectively as a first transfer process. More specifically, a first transfer bias voltage is applied to the first transfer roller 622 in order to charge the rear surface (which contacts the first transfer roller 622) of the transfer target medium 621 with electricity of the polarity opposite to that of toner so that the toner images are electrostatically transferred to the transfer target medium 621.

The superimposed toner image on the transfer target medium 621 is then transferred to a recording sheet P which is passed through the second transfer nip portion as a second transfer process. More specifically, a second transfer bias voltage is applied to the second transfer roller 623 in order to charge the back side of the recording sheet P, i.e. the side which contacts the second transfer roller 623, with electricity of the polarity opposite to that of toner so that the superimposed toner image is electrostatically transferred to the recording sheet P. The recording sheet P with the transferred toner image is conveyed to the fixing unit 630.

The belt cleaning unit 624 includes a belt cleaning blade, which is in slidable contact with the surface of the transfer target medium 621, and so forth. The belt cleaning unit 624 removes toner which remains on the surface of the transfer target medium 621 after the second transfer process.

Meanwhile, in the intermediate transfer unit 620, the function of the second transfer roller 623 can be implemented by an alternative structure, i.e., a so-called belt-type second transfer unit, consisting of a second transfer belt (not shown in the figure) which is wound around a plurality of support rollers including the second transfer roller 623 in the form of a loop.

Next, the fixing unit 630 will be explained. The fixing unit 630 is provided with a fixing roller 631, a pressure roller 632, a heating unit 633 and the like to fix a toner image transferred by the image forming unit 60 to a recording sheet P. Specifically, the fixing unit 630 forms a fixing nip between the fixing roller 631 and the pressure roller 632 which are urged against each other. In the fixing unit 630, the heating unit 633 heats the fixing roller 631. The fixing unit 630 fixes an image to a recording sheet P under the pressure applied by the pressure roller 632 and the heat applied through the fixing roller 631. An image is thereby printed on the recording sheet P after fixing treatment by the fixing unit 630. After printing the image, the recording sheet P is discharged outwards by discharging rollers 304, and for example stacked on the catch tray 305. Alternatively, the recording sheet P with the image printed thereon may not be stacked on the catch tray 305 but transferred to another apparatus which is not shown in the figure.

Next, the paper feed unit 20 will be explained. The paper feed unit 20 is provided with a paper feed cassette 200, feed rollers 201 and the like. The paper feed cassette 200 accommodates recording sheets P. The feed rollers 201 take in the recording sheets P accommodated in the paper feed cassette 200 and feed out the recording sheets P to the conveyance unit Next, the conveyance unit 30 will be explained. The conveyance unit 30 includes a conveying route 300 along which recording sheets P are conveyed. The conveying route 300 is provided with a paper feed roller 302A, conveyance rollers 302B, 302C and 302D, a paper stop roller 303 and so forth.

The conveying route 300 conveys a recording sheet P fed from the paper feed unit 20 to the image forming unit 60. Meanwhile, in the case where an image is to be formed also on the back side of a recording sheet P, the recording sheet P is conveyed through a paper circulation route 307A, a sheet reversing route 307B and a refeeding conveying route 307C in this order by a branch section 306 after forming an image on the front side of the recording sheet P.

Next, the control system of the image forming apparatus 1 will be explained. The image forming apparatus 1 performs various types of processing through the control unit 41. For example, the image reading signal Sout which is output from the image reading unit 12 is transmitted to the image processing unit 43 or an image memory (not shown in the figure) through the control unit 41. The image memory consists, for example, of a hard disk. On the other hand, the control unit 41 controls a drive unit 1001 to be described below by transmitting a control command to a motor which is not shown in the figure. The drive unit 1001 is thereby controlled to rotate a drive shaft 1011 to be described below.

Specifically, the control unit 41 mainly consists of a CPU, a ROM, a RAM, and an I/O interface. The CPU of the control unit 41 reads various programs from the ROM or a memory which is not shown in the figure in accordance with required processes, loads the programs on the RAM, and executes the loaded programs to cooperate with the control unit 41. The control unit 41 can control the elements of the image forming apparatus 1 in this manner.

In other words, the control unit 41 is responsible for controlling the operation of the image forming apparatus 1 and implemented with a microcomputer which mainly consists of the CPU, the ROM, the RAM, and the I/O interface which are not shown in the figure. A predetermined control program is run by the control unit 41 to implement the functions of the image forming apparatus 1.

The image processing unit 43 mainly consists of a CPU, a ROM, a RAM, and an I/O interface which are not shown in the figure. The CPU of the image processing unit 43 reads various programs from the ROM or a memory which is not shown in the figure in accordance with required processes, loads the programs on the RAM, and executes the loaded programs to cooperate with the image processing unit 43. The functions required of the image processing unit 43 can be implemented in this manner. For example, working areas are defined in the RAM in units of lines and in units of picture elements to which are supplied image data, i.e., the signals Dy, Dm, Dc and Dk. The image processed data is temporarily stored in advance of supplying to the image forming unit 60.

Alternatively, the image processing unit 43 can mainly consist of a DSP (Digital Signal Processor). In this case, in a RAM of the DSP, working areas are defined in units of lines and in units of picture elements to which are supplied image data, i.e., the signals Dy, Dm, Dc and Dk, in the same manner as in the RAM explained above. The image processed data is temporarily stored in advance of supplying to the image forming unit 60.

Figure 2:
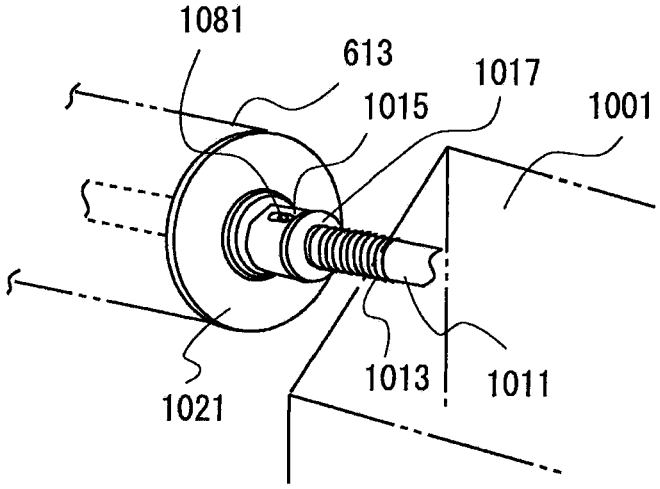
FIG. 2 is a perspective view showing the connection structure between an image bearing member 613 and a drive unit 1001 in accordance with the embodiment.

Next, the structure around the image bearing member 613 will specifically be explained with reference to FIGS. 2 to 9. FIG. 2 is a perspective view showing the connection structure between the image bearing member 613 and the drive unit 1001. As shown in FIG. 2, the drive unit 1001 incorporates a gear train or the like housed therein. The drive unit 1001 rotates the drive shaft 1011 by rotating the gear train or the like with a motor which is not shown in the figure. The drive shaft 1011 transmits a rotation force to the image bearing member 613.

Accordingly, the rotation of the image bearing member 613 can be controlled by controlling the rotation of the drive shaft 1011 through the drive unit 1001. A flange 1021 is attached to the end portion of the image bearing member 613. The flange 1021 connects the drive shaft 1011 and the image bearing member 613 through a drive coupling 1015 and a taper coupling 1017. The drive coupling 1015 transmits the rotation force of the drive shaft 1011 to the image bearing member 613 through a transmission pin 1081.

The drive shaft 1011 is provided with a pressing member 1013. The pressing member 1013 is composed of a resilient member and press the taper coupling 1017 in the axial direction of the drive shaft 1011. The pressing member 1013 is located between the drive unit 1001 and the taper coupling 1017. The pressing member 1013 consists for example of a helical spring which can apply a pressing force.

Figure 3:
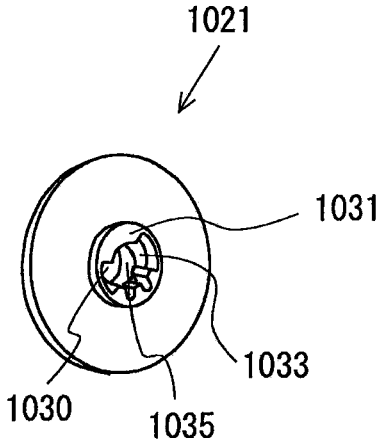
FIG. 3 is a perspective view showing a flange 1021 of the image bearing member 613 in accordance with the embodiment.

Next, the flange 1021 will specifically be explained. FIG. 3 is a perspective view showing the flange 1021 of the image bearing member 613. A convex portion 1031 and a concave portion 1033 are formed on the flange 1021. The convex portion 1031 and the concave portion 1033 are portions which are engaged with the drive coupling 1015. Also, a collet portion 1035 is formed on the flange 1021. The collet portion 1035 is a portion which is engaged with the taper coupling 1017. Incidentally, a through hole 1030 is formed at the center of the flange 1021 in order that the drive shaft 1011 can pass through the flange 1021. Accordingly, the convex portion 1031, the concave portion 1033 and the collet portion 1035 are located around the through hole 1030.

Figure 4:
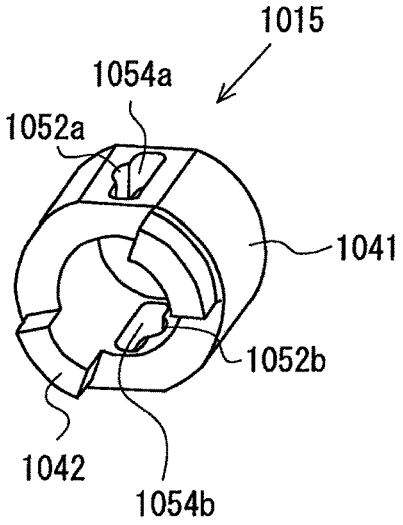
FIG. 4 is a perspective view showing a drive coupling 1015 in accordance with the embodiment.

Next, the drive coupling 1015 will specifically be explained. FIG. 4 is a perspective view showing the drive coupling 1015. The drive coupling 1015 is supported movably in the axial direction of the drive shaft 1011. The drive coupling 1015 couples the drive shaft 1011 and the flange 1021 of the image bearing member 613 with a play. The drive coupling 1015 consists of claw portions 1042 and a body portion 1041.

The claw portions 1042 engage with the flange 1021 of the image bearing member 613. Specifically, the claw portions 1042 engage with the convex portion 1031 and the concave portion 1033 of the flange 1021 with a play.

The length of the body portion 1041 in the axial direction of the drive shaft 1011 is shorter than the distance between the flange 1021 of the image bearing member 613 and the rear end 1063 of the taper coupling 1017. A first oblong hole 1054*a* is formed through the body portion 1041 along in the axial direction of the drive shaft 1011 to have a short diameter which is larger than the diameter of the transmission pin 1081. Also, a second oblong hole 1054*b* is formed opposite to the first oblong hole 1054*a* through the body portion 1041 along in the axial direction of the drive shaft 1011 to have a short diameter which is larger than the diameter of the transmission pin 1081.

A first indentation 1052*a* is formed in the long diameter side of the first oblong hole 1054*a* along the rotation direction of a first end portion of the transmission pin 1081. A second indentation 1052*b* is formed in the long diameter side of the second oblong hole 1054*b* along the rotation direction of a second end portion of the transmission pin 1081. The first indentation 1052*a* and the second indentation 1052*b* are formed respectively in such positions as to come in contact with the transmission pin 1081 at the same time when the transmission pin 1081 transmits a rotation force to the drive coupling 1015.

Figure 5:
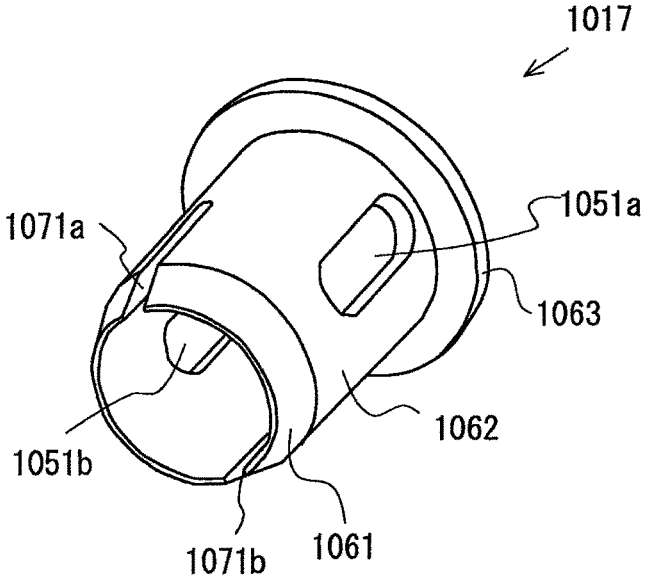
FIG. 5 is a perspective view showing a taper coupling 1017 in accordance with the embodiment.

Next, the taper coupling 1017 will specifically be explained. FIG. 5 is a perspective view showing the taper coupling 1017. The taper coupling 1017 is, for example, a resin-molded member and consists of a tip portion 1061, an axial portion 1062 and a rear end portion 1063.

The tip portion 1061 has a tapered chuck structure and comes in surface contact with the drive shaft 1011 and the flange 1021 of the image bearing member 613 by the elastic force of the tapered chuck structure and the pressing force of the pressing member 1013. Incidentally, cut portions 1071*a* and 1071*b* are formed from the tip portion 1061 through part of the axial portion 1062.

The axial portion 1062 has a cylindrical structure whose outer diameter is smaller than the inner diameter of the drive coupling 1015. Third oblong holes 1051*a* and 1051*b* aligned in the axial direction of the drive shaft 1011 is formed in opposite sides of the axial portion 1062. Each of the third oblong holes 1051*a* and 1051*b* has a short diameter which is larger than the diameter of the transmission pin 1081. Incidentally, the third oblong holes 1051*a* and 1051*b* are referred to simply as the third oblong hole 1051 when they need not be distinguished.

The rear end portion 1063 is formed with a surface which comes in contact with the pressing member 1013. The rear end portion 1063 prevents the drive coupling 1015 from slipping out in the axial direction of the drive shaft 1011.

Figure 6:
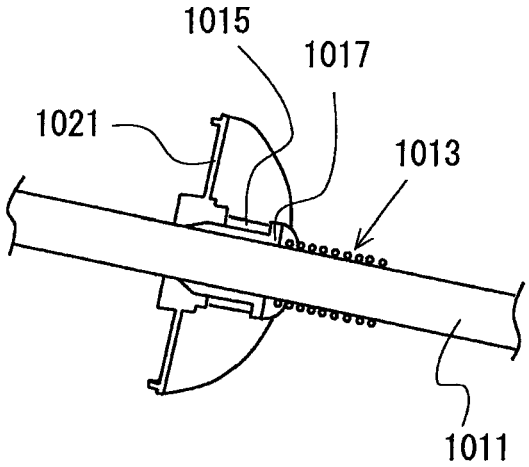
FIG. 6 is a cross sectional view for showing the assembled structure including a drive shaft 1011, a pressing member 1013, the drive coupling 1015, the taper coupling 1017 and the flange 1021 in accordance with the embodiment.

Next is the description of the structure in which the rotation force of the drive shaft 1011 is transmitted to the flange 1021 by the use of the drive coupling 1015 and the taper coupling 1017. FIG. 6 is a cross sectional view for showing the assembled structure including the drive shaft 1011, the pressing member 1013, the drive coupling 1015, the taper coupling 1017 and the flange 1021. As shown in FIG. 6, the drive shaft 1011 is inserted into the taper coupling 1017. Furthermore, the taper coupling 1017 is inserted into the axial portion 1062 of the drive coupling 1015 and pressed by the pressing member 1013.

Figure 7:
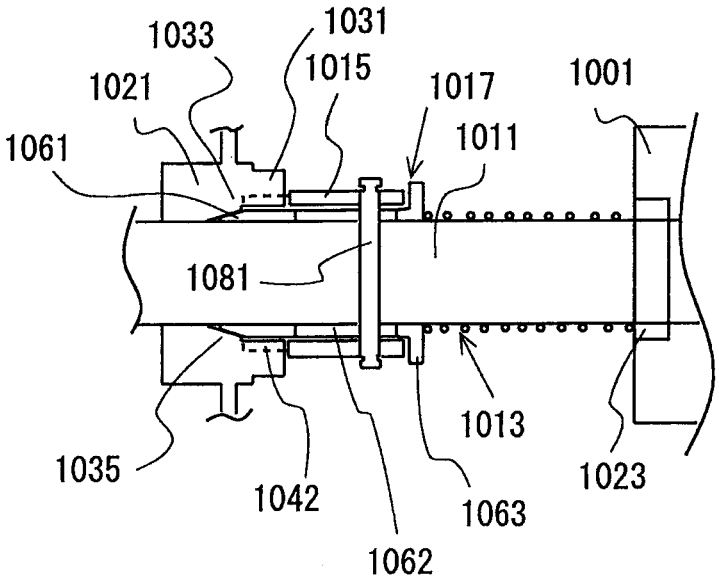
FIG. 7 is a cross sectional detailed view for showing the assembled structure including the drive shaft 1011, the pressing member 1013, the drive coupling 1015, the taper coupling 1017 and the flange 1021 in accordance with the embodiment.

FIG. 7 is a cross sectional detailed view for showing the assembled structure including the drive shaft 1011, the pressing member 1013, the drive coupling 1015, the taper coupling 1017 and the flange 1021. As illustrated in FIG. 7, the drive shaft 1011 is supported by a flange 1023 of the drive unit 1001, and also supported by the flange 1021 of the image bearing member 613.

The tip portion 1061 of the taper coupling 1017 and the collet portion 1035 of the flange 1021 are connected by chucking. The tip portion 1061 of the taper coupling 1017 is urged against the collet portion 1035 of the flange 1021 by the pressing force of the pressing member 1013 exerted on the rear end portion 1063. Furthermore, the taper coupling 1017 is supported by the axial portion 1062 of the drive coupling 1015 with a play. In this configuration, the drive shaft 1011 and the flange 1021 of the image bearing member 613 can be coupled without rattling.

The drive coupling 1015 is connected to the flange 1021 through the concave portion 1033, the convex portion 1031 and the claw portions 1042 with a play, and also connected to the taper coupling 1017 with a play.

However, the transmission pin 1081 is passed through the drive coupling 1015 and the taper coupling 1017. The transmission pin 1081 is passed also through the drive shaft 1011. The oscillation of the drive coupling 1015 is thereby transmitted to the transmission pin 1081. The oscillation transmitted to the transmission pin 1081 will be explained in detail with reference to FIG. 8.

Figure 8:
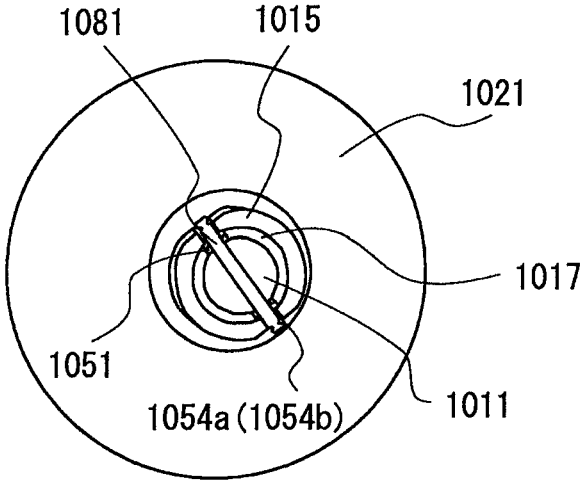
FIG. 8 is a cross sectional view for showing the assembled structure including the drive shaft 1011, the drive coupling 1015, the taper coupling 1017, a third oblong holes 1051, a second oblong hole 1054*b*, a first oblong hole 1054*a* and a transmission pin 1081.

FIG. 8 is a cross sectional view for showing the assembled structure including the drive shaft 1011, the drive coupling 1015, the taper coupling 1017, the third oblong holes 1051, the second oblong hole 1054*b*, the first oblong hole 1054*a* and the transmission pin 1081. As has been discussed above, the drive coupling 1015 and the taper coupling 1017 are arranged with a play. On the other hand, the inner diameter of the drive coupling 1015 is larger than the outer diameter of the taper coupling 1017. By this configuration, the taper coupling 1017 and the drive coupling 1015 are arranged with a play. The oscillation of the drive coupling 1015 is thereby not transmitted to the taper coupling 1017.

For example, even when the center of the flange 1021 of the image bearing member 613 is misaligned with the center of the drive coupling 1015 to cause the oscillation of the drive coupling 1015, the oscillation of the drive coupling 1015 is not transmitted to the taper coupling 1017 through the transmission pin 1081. The rotation irregularity of the drive coupling 1015 caused by the oscillation of the drive coupling 1015 is thereby not transmitted to the image bearing member 613. Accordingly, the rotation irregularity of the image bearing member 613 is inhibited.

Figure 9:
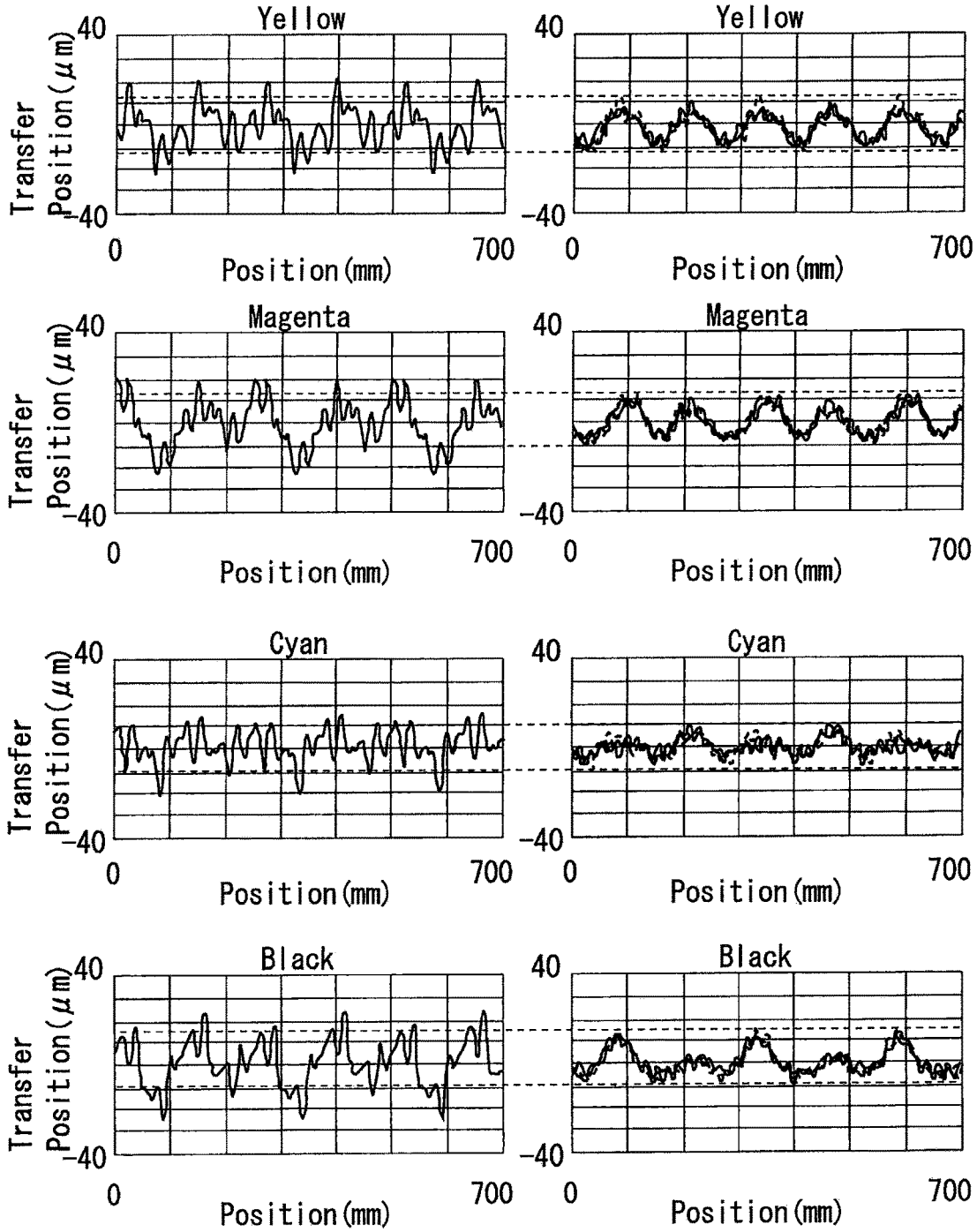
FIG. 9 is a view for comparing color shift amounts depending on presence or absence of the taper coupling 1017 in accordance with the embodiment.

FIG. 9 is a view for comparing color shift amounts depending on presence or absence of the taper coupling 1017. Of charts in FIG. 9, the charts on the left column show the transfer positions of the image bearing member 613 in the case where the taper coupling 1017 is not used. On the other hand, of the charts in FIG. 9, the charts on the right column show the transfer positions of the image bearing member 613 in the case where the taper coupling 1017 is used. As illustrated in FIG. 9, since the taper coupling 1017 is supported by the inside surface of the drive coupling 1015 with a play, the color shift amounts of the transfer positions of the image bearing member 613 is significantly improved.

The rotation irregularity of the image bearing member 613 of the image forming apparatus 1 can be inhibited in this manner. Accordingly, in the image forming apparatus 1, it is possible to prevent the color shift amounts of toner images corresponding to the colors formed on the image bearing members 613 respectively.

Specifically, the drive shaft 1011 and the flange 1021 of the image bearing member 613 are coupled through the drive coupling 1015 with a play, and the taper coupling 1017 is interposed between the drive coupling 1015 and the drive shaft 1011. The taper coupling 1017 is provided as a separate member from the drive coupling 1015, and has plays (spaces for movement) both between it and the drive coupling 1015 and between it and the drive shaft 1011.

More specifically, since the tip portion 1061 of the taper coupling 1017 has a tapered chuck structure, the drive shaft 1011 and the flange 1021 of the image bearing member 613 can be engaged without rattling. It is therefore possible to remove the rattling between the drive shaft 1011 and the image bearing member 613. Also, since the axial portion 1062 of the taper coupling 1017 has a diameter which is smaller than the inner diameter of the drive coupling 1015, the oscillation caused by a small rattling occurring during driving is not transmitted to the image bearing member 613. The rotation irregularity of the image bearing member 613 is thereby not deteriorated.

In the case of the image forming apparatus 1, therefore, the drive coupling 1015 couples the drive shaft 1011 and the flange 1021 of the image bearing member 613 with a play, and the taper coupling 1017 is interposed between the drive coupling 1015 and the drive shaft 1011. The taper coupling 1017 is provided as a separate member from the drive coupling 1015, and has plays (spaces for movement) both between it and the drive coupling 1015 and between it and the drive shaft 1011.

Specifically, since the tip portion 1061 of the taper coupling 1017 has a tapered chuck structure, the drive shaft 1011 and the flange 1021 of the image bearing member 613 can be engaged without rattling. It is therefore possible to remove the rattling between the drive shaft 1011 and the image bearing member 613. Also, since the axial portion 1062 of the taper coupling 1017 has a diameter which is smaller than the inner diameter of the drive coupling 1015, the drive coupling 1015 is given such a space that it can move in the axial direction of the drive shaft 1011 so that the oscillation caused by a small rattling occurring during driving is not transmitted to the image bearing member 613. The rotation irregularity of the image bearing member 613 is thereby not deteriorated.

In accordance with the image forming apparatus 1 as described above, while inhibiting the rattling between the drive shaft 1011 and the image bearing member 613 by the taper coupling 1017 which is formed separately from the drive coupling 1015, the rotation irregularity of the image bearing member 613 can be prevented from being deteriorated by the drive coupling 1015 having a space with which it can move in the axial direction of the drive shaft 1011 so that a good image quality can be obtained without color shifts.

The first indentation 1052*a* is formed in the long diameter side of the first oblong hole 1054*a* along the rotation direction of the first end portion of the transmission pin 1081. On the other hand, the second indentation 1052*b* is formed in the long diameter side of the second oblong hole 1054*b* along the rotation direction of the second end portion of the transmission pin 1081. Since the first indentation 1052*a* and the second indentation 1052*b* are formed in the rotation direction of the transmission pin 1081, when the drive shaft 1011 is rotating together with the transmission pin 1081, the first end portion of the transmission pin 1081 stays in the first indentation 1052*a*, and the second end portion of the transmission pin 1081 stays in the second indentation 1052*b*.

More specifically speaking, since the short diameter of the first oblong hole 1054*a* formed on the drive coupling 1015 is larger than the diameter of the transmission pin 1081, there is a space between the transmission pin 1081 and the first oblong hole 1054*a*. Also, since the short diameter of the second oblong hole 1054*b* formed on the drive coupling 1015 is larger than the diameter of the transmission pin 1081, there is a space between the transmission pin 1081 and the second oblong hole 1054*b*. Accordingly, when the drive coupling 1015 rotates in association with the rotation of the drive shaft 1011, the opposite end portions of the transmission pin 1081 moves in the opposite directions respectively in the first oblong hole 1054*a* and the second oblong hole 1054*b*. In this case, the opposite end portions of the transmission pin 1081 come in contact with the first oblong hole 1054*a* and the second oblong hole 1054*b* at the same time so that the center of rotation does not move. The rotation irregularity of the image bearing member 613 can thereby be reduced.

In accordance with the image forming apparatus 1, thereby, the transmission pin 1081 comes in contact with the first oblong hole 1054*a* and the second oblong hole 1054*b* respectively at the same time during the rotation of the drive shaft 1011 without moving the center of rotation so that the rotation irregularity of the image bearing member 613 can be reduced.

Also, the first indentation 1052*a* is formed on the first oblong hole 1054*a* along the rotation direction of the first end portion of the transmission pin 1081. On the other hand, the second indentation 1052*b* is formed on the second oblong hole 1054*b* along the rotation direction of the second end portion of the transmission pin 1081. By this configuration, while the transmission pin 1081 rotates, the first end portion of the transmission pin 1081 moves toward the first indentation 1052*a*, and the second end portion of the transmission pin 1081 moves toward the second indentation 1052*b*. As a result, while the drive shaft 1011 is rotating, the transmission pin 1081 finally continues rotating with the opposite end portions being stored in the first indentation 1052*a* and the second indentation 1052*b* respectively.

Furthermore, while the drive shaft 1011 is rotating, the transmission pin 1081 is rotating integrally with the drive coupling 1015 through the first oblong hole 1054*a* and the second oblong hole 1054*b*. Accordingly, when the drive coupling 1015 is oscillating due to misalignment between the center of the flange 1021 of the image bearing member 613 and the center of the drive coupling 1015, the oscillation of the drive coupling 1015 is transmitted to the transmission pin 1081.

However, even if there occurs substantial oscillation of the drive coupling 1015, the oscillation transmitted to the transmission pin 1081 is absorbed by the first indentation 1052*a* and the second indentation 1052*b* so that the rotation irregularity of the image bearing member 613 can be substantially reduced.

In accordance with the image forming apparatus 1, thereby, the oscillation of the drive coupling 1015 is not transmitted to the image bearing member 613 in the light of the first indentation 1052*a* and the second indentation 1052*b* so that the rotation irregularity of the image bearing member 613 can be substantially reduced.

Furthermore, while the drive shaft 1011 is rotating, the transmission pin 1081 comes in contact with the first indentation 1052*a* and the second indentation 1052*b* to cancel the misalignment of the center of rotation so that the rotation irregularity of the image bearing member 613 can be reduced. Accordingly, a good image quality can be obtained in which color shifts are significantly suppressed.

As has been discussed above, the image forming apparatus 1 of the present embodiment transfers toner images formed on the image bearing members 613 to the transfer target medium 621, and comprises: the drive shaft 1011 structured to transmit a rotation force to the image bearing member 613; the drive coupling 1015 supported movably in the axial direction of the drive shaft 1011 and structured to couple the drive shaft 1011 and the flange 1021 of the image bearing member 613 with a play; the taper coupling 1017 supported inside the drive coupling 1015 and structured to hold the drive shaft 1011 and the flange 1021 of the image bearing member 613; the pressing member 1013 structured to press the taper coupling 1017 in the axial direction of the drive shaft 1011, wherein the taper coupling 1017 consists of the tip portion 1061 having a tapered chuck structure and coming in surface contact with the drive shaft 1011 and the flange 1021 of the image bearing member 613 by the elastic force of the tapered chuck structure and the pressing force of the pressing member 1013, the axial portion 1062 having a cylindrical structure whose outer diameter is smaller than the inner diameter of the drive coupling 1015, and the rear end portion 1063 formed with a surface which comes in contact with the pressing member 1013, and wherein the drive coupling 1015 consists of the claw portions 1042 engaging with the flange 1021 of the image bearing member 613, and the body portion 1041 having a length which is shorter than the distance between the flange 1021 of the image bearing member 613 and the rear end 1063 of the taper coupling 1017 in the axial direction of the drive shaft 1011.

By this configuration, in accordance with the image forming apparatus 1, a good image quality can be obtained without color shifts.

Also, the image forming apparatus 1 of the present embodiment is further provided with the transmission pin 1081 which is passed through the drive shaft 1011 to transmit a rotation force to the drive coupling 1015, and the drive coupling 1015 is formed with the first oblong hole 1054*a* formed on the body portion 1041 along the axial direction of the drive shaft 1011 and having a short diameter which is larger than the diameter of the transmission pin 1081, the second oblong hole 1054*b* formed on the body portion 1041 along the axial direction of the drive shaft 1011, located opposite to the first oblong hole 1054*a* and having a short diameter which is larger than the diameter of the transmission pin 1081, the first indentation 1052*a* formed in the long diameter side of the first oblong hole 1054*a* along the rotation direction of the first end portion of the transmission pin 1081, and the second indentation 1052*b* formed in the long diameter side of the second oblong hole 1054*b* along the rotation direction of the second end portion of the transmission pin 1081.

By this configuration, in accordance with the image forming apparatus 1, the rotation irregularity of the image bearing member 613 can be significantly reduced.

Furthermore, in accordance with the image forming apparatus 1 of the present embodiment, the first indentation 1052*a* and the second indentation 1052*b* are formed respectively in such positions as to come in contact with the transmission pin 1081 at the same time when the transmission pin 1081 transmits a rotation force to the drive coupling 1015.

By this configuration, in accordance with the image forming apparatus 1, a good image quality can be obtained in which color shifts are significantly suppressed.

The image processing apparatus 1 have been explained based on the embodiments in accordance with the present invention. However, it is not intended to limit the present invention to the precise form described, and obviously many modifications and variations are possible without departing from the scope of the invention.

For example, while the pressing member 1013 of the above embodiment consists of a helical spring, it is not limited thereto but can be another member capable of applying an elastic force.

Also, while the taper coupling 1017 of the above embodiment is a resin-molded member, it is not limited thereto but can be another thin soft member capable of applying an elastic force.

Furthermore, while the image reading signal Sout of the above embodiment is given as digital image data (RGB code) defined in the RGB color space, it is not limited thereto but can be defined in another color space such as the L*a*b* color space.

What is claimed is:

1. An image forming apparatus which transfers toner images formed on an image bearing member to a transfer target medium, and comprises:

a drive shaft structured to transmit a rotation force to the image bearing member;

a drive coupling supported movably in an axial direction of the drive shaft and structured to couple the drive shaft and a flange of the image bearing member with a play;

a taper coupling supported inside the drive coupling and structured to hold the drive shaft and the flange of the image bearing member;

a pressing member structured to press the taper coupling in the axial direction of the drive shaft, the taper coupling comprising:

a tip portion having a tapered chuck structure and coming in surface contact with the drive shaft and the flange of the image bearing member by an elastic force of the tapered chuck structure and a pressing force of the pressing member; and an axial portion having a cylindrical structure whose outer diameter is smaller than the inner diameter of the drive coupling; and a rear end portion formed with a surface which comes in contact with the pressing member, the drive coupling comprising:

a claw portions engaging with the flange of the image bearing member; and a body portion having a length which is shorter than the distance between the flange of the image bearing member and the rear end of the taper coupling in the axial direction of the drive shaft.

2. The image forming apparatus of claim 1 further comprising:

a transmission pin which is passed through the drive shaft to transmit a rotation force to the drive coupling, the drive coupling comprising:

a first oblong hole formed on the body portion along the axial direction of the drive shaft and having a short diameter which is larger than the diameter of the transmission pin;

a second oblong hole formed along the axial direction of the drive shaft opposite to the first oblong hole on the body portion and having a short diameter which is larger than the diameter of the transmission pin; and a first indentation formed in a long diameter side of the first oblong hole along a rotation direction of the first end portion of the transmission pin; and a second indentation formed in the long diameter side of the second oblong hole along a rotation direction of the second end portion of the transmission pin.

3. The image forming apparatus of claim 2 wherein the first indentation and the second indentation are formed respectively in such positions as to come in contact with the transmission pin at the same time when the transmission pin transmits a rotation force to the drive coupling.

4. The image forming apparatus of claim 1, wherein the taper coupling further comprises a plurality of cuts extending through the tip portion and the axial portion.

5. The image forming apparatus of claim 1, further comprising a transmission pin which is passed through the drive shaft to transmit a rotation force to the drive coupling, wherein the taper coupling further comprises holes formed through the axial portion, and the transmission pin passes through the holes.

* * * * *